US007910536B2

(12) United States Patent
Briatore et al.

(10) Patent No.: US 7,910,536 B2
(45) Date of Patent: Mar. 22, 2011

(54) BLEACHING COMPOSITION COMPRISING AN ALKOXYLATED BENZOIC ACID

(75) Inventors: Andrea Briatore, Chieti (IT); Alessandro Gagliardini, Jesi (IT); Michael Alan John Moss, Rome (IT); Oreste Todini, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/437,609

(22) Filed: May 8, 2009

(65) Prior Publication Data

US 2009/0218544 A1 Sep. 3, 2009

Related U.S. Application Data

(63) Continuation of application No. 11/827,500, filed on Jul. 12, 2007, now abandoned, which is a continuation of application No. 11/544,402, filed on Oct. 6, 2006, now abandoned, which is a continuation of application No. 10/805,771, filed on Mar. 22, 2004, now abandoned.

(30) Foreign Application Priority Data

Mar. 28, 2003 (EP) ..... 03447068

(51) Int. Cl.

| | |
|---|---|
| ***C11D 3/00*** | (2006.01) |
| ***C11D 7/18*** | (2006.01) |
| ***C11D 7/42*** | (2006.01) |
| ***C11D 17/00*** | (2006.01) |
| ***C11D 3/02*** | (2006.01) |
| ***C11D 3/20*** | (2006.01) |
| ***C11D 3/39*** | (2006.01) |
| ***C11D 3/42*** | (2006.01) |

(52) U.S. Cl. ..... 510/370; 510/191; 510/218; 510/219; 510/238; 510/303; 510/307; 510/325; 510/379; 510/380; 510/394

(58) Field of Classification Search ..... 510/191, 510/218, 219, 238, 303, 307, 325, 370, 380, 510/394

See application file for complete search history.

(56) References Cited

U.S. PATENT DOCUMENTS

| | | | |
|---|---|---|---|
| 2,082,275 | A | 6/1937 | Daimler et al. |
| 2,255,082 | A | 9/1941 | Orthner et al. |
| 2,438,091 | A | 3/1948 | Lynch et al. |
| 2,528,378 | A | 10/1950 | Mannheimer et al. |
| 2,658,072 | A | 11/1953 | Kosmin et al. |
| 2,702,279 | A | 2/1955 | Funderburk et al. |
| 3,812,044 | A | 5/1974 | Connor et al. |
| 4,704,233 | A | 11/1987 | Hartman et al. |
| 6,294,511 | B1 | 9/2001 | Argo et al. |
| 2002/0077265 | A1 | 6/2002 | Buzzacarini et al. |
| 2003/0148909 | A1 | 8/2003 | Del Duca et al. |
| 2003/0154556 | A1 | 8/2003 | Del Duca et al. |
| 2003/0232733 | A1 | 12/2003 | Appel et al. |
| 2008/0261855 | A1 | 10/2008 | Briatore et al. |

FOREIGN PATENT DOCUMENTS

| | | | |
|---|---|---|---|
| EP | 0 668 345 | A1 | 8/1995 |
| EP | 0 867 502 | A1 | 9/1998 |
| EP | 1 001 010 | A1 | 5/2000 |
| EP | 1 001 011 | A2 | 5/2000 |
| GB | 2 271 119 | A | 4/1994 |
| WO | WO 00/27972 | A1 | 5/2000 |
| WO | WO 00/27978 | A1 | 5/2000 |
| WO | WO 01/52801 | A1 | 7/2001 |

OTHER PUBLICATIONS

Javel, "Analyses des Eaux et Extraits de Javel", by "La chamber syndcale nationale de L'eau de Javel et des produits connexes" pp. 14-18, (1997).

*Primary Examiner* — Lorna M Douyon
*Assistant Examiner* — Jaison P Thomas
(74) *Attorney, Agent, or Firm* — Andrew J. Mueller; Leonard W. Lewis

(57) ABSTRACT

The present invention relates to a liquid bleaching composition comprising a hypohalite bleach, a trimethoxy benzoic acid or a salt thereof and a compound selected from the group consisting of bleach-unstable brighteners, and bleach-unstable coloring-agents and mixtures thereof.

2 Claims, No Drawings

BLEACHING COMPOSITION COMPRISING AN ALKOXYLATED BENZOIC ACID

CROSS REFERENCE TO RELATED APPLICATIONS

This application is a continuation of and claims priority under 35 U.S.C. §120 to U.S. application Ser. No. 11/827,500 filed Jul. 12, 2007 now abandoned, which in turn is a continuation of and claims priority under 35 U.S.C. §120 to U.S. application Ser. No. 11/544,402 filed Oct. 6, 2006 (now abandoned), which in turn is a continuation of and claims priority under 35 U.S.C. §120 to U.S. application Ser. No. 10/805,771 filed Mar. 22, 2004 (now abandoned).

TECHNICAL FIELD

The present invention relates to bleaching compositions, in particular to hypohalite bleaching compositions, which can be used to treat various surfaces including, but not limited to, fabrics, clothes, carpets and the like as well as hard-surfaces like walls, tiles, floors, glass, bathrooms surfaces, kitchen surfaces, toilet bowls and dishes.

BACKGROUND OF THE INVENTION

Bleach-containing compositions for bleaching various surfaces, e.g., fabrics, are well known in the art. Amongst the different bleaching compositions available, those relying on bleaching by hypohalite bleach, such as hypochlorite, are often preferred, mainly for bleaching performance reasons.

It is desirable to add further ingredients to hypohalite bleach-containing compositions. Indeed, in order to improve the whitening performance of such bleaching compositions the addition of a brightener (also known as fluorescent whitening agent) can be beneficial. Furthermore, in order to improve the aesthetics of such bleaching compositions the addition of a dye or a pigment can be considered.

However, a drawback associated with the use of hypohalite bleach-containing compositions, e.g., hypochlorite-based compositions, is that certain further ingredients, added in addition to the hypohalite bleach, can be decomposed by the bleach. Indeed, hypohalite bleaches are oxidising agents and certain further ingredients can be prone to attacks and in some cases partial or even complete decomposition by such oxidising agents. Hence, certain further ingredients, such as certain brighteners, certain pigments and/or certain dyes, are difficult to incorporate in hypohalite bleach-containing compositions. Further ingredients that are prone to partial or even complete decomposition in hypohalite bleach-containing compositions are herein referred to as "bleach-unstable" ingredients. Whereas, further ingredients that are not prone to partial or even complete decomposition in hypohalite bleach-containing compositions are herein referred to as "bleach-stable" ingredients.

One way to avoid partial or even complete decomposition of further ingredients in hypohalite bleach-containing compositions is to carefully select bleach-stable ingredients for such hypohalite bleach-containing compositions. Indeed, when formulating a hypohalite bleach-containing composition, a bleach-stable brightener can be chosen over a bleach-unstable brightener. However, in some instances bleach-stable ingredients show an inferior performance or benefit when compared to their bleach-unstable counterparts. Indeed, especially the bleach-stable species of brighteners, pigments and dyes show a significantly inferior performance or benefit as compared to their bleach-unstable counterparts.

Another way of avoiding partial or even complete decomposition of further ingredients present in hypohalite bleach-containing compositions is to incorporate stabilization systems into the bleaching compositions. Indeed, it is known in the art to add to hypohalite bleach-containing compositions a radical scavenger or another stabilising agent in order to prevent or at least reduce the decomposition of further ingredients, in particular bleach-unstable ingredients, present in the bleaching compositions. For example, EP-A-0 668 345 and EP-A-1 001 010 describe bleaching compositions comprising a hypohalite bleach and a radical scavenger. However, even though such stabilization systems and especially radical scavengers are capable of stabilising certain further bleach-unstable ingredients, such as surfactants, it has been found that bleach-unstable brighteners, bleach-unstable pigments and/or bleach-unstable dyes are particularly prone to attacks by hypohalite bleaches and hence are extremely difficult to be stably incorporated into bleaching compositions comprising the known stabilization systems.

Indeed, although the systems described in the art provide stabilization of further bleach-unstable ingredients in hypohalite bleach-containing compositions, it has been found that the stabilization of bleach-unstable brighteners, bleach-unstable coloring-agents (such as pigments and/or dyes) may still be further improved. Indeed, especially the stabilization of such bleach-unstable brighteners, bleach-unstable coloring-agents (such as pigments and/or dyes) upon prolonged periods of storage ("upon storage") may still be further improved.

It is therefore an objective of the present invention to provide a hypohalite bleach-containing bleaching composition comprising a compound selected from the group consisting of bleach-unstable brighteners, and bleach-unstable coloring-agents and mixtures thereof, wherein the decomposition of said compound is significantly reduced or even prevented.

It has now been found that this objective can be met by a liquid bleaching composition comprising a hypohalite bleach, a trimethoxy benzoic acid or a salt thereof and a compound selected from the group consisting of bleach-unstable brighteners, and bleach-unstable coloring-agents and mixtures thereof.

Advantageously, the bleaching composition as described herein also provides a significant reduction or even prevention of the decomposition of a compound selected from the group consisting of bleach-unstable brighteners, and bleach-unstable coloring-agents and mixtures thereof upon storage of said bleaching composition A further advantage of the bleaching compositions according to the present invention is that they show an excellent bleaching performance.

In particular, the compositions of the present invention provide excellent bleaching performance when used in any laundry application ("fabric treatment applications"), e.g., as a laundry detergent, a laundry additive and/or a laundry pretreater.

Another advantage of the compositions of the present invention is that they are suitable for the cleaning of different types of fabrics including natural fabrics (e.g., fabrics made of cotton, viscose, linen, silk and wool), synthetic fabrics such as those made of polymeric fibers of synthetic origin as well as those made of both natural and synthetic fibers.

Yet another advantage of the bleaching compositions of the present invention is that said bleaching compositions are also suitable for the bleaching of different types of surfaces including hard-surfaces like floors, walls, tiles, glass, kitchen surfaces, bathrooms surfaces, toilet bowls and/or dishes and the like, in addition to the above mentioned fabric treatment applications.

SUMMARY OF THE INVENTION

The present invention encompasses a liquid bleaching composition comprising a hypohalite bleach, a trimethoxy benzoic acid or a salt thereof and a compound selected from the group consisting of bleach-unstable brighteners, and bleach-unstable coloring-agents and mixtures thereof.

DETAILED DESCRIPTION OF THE INVENTION

The Bleaching Composition

The bleaching compositions herein are formulated as liquids including gel and paste form. The bleaching compositions are preferably but not necessarily formulated as aqueous compositions. Preferred liquid bleaching compositions of the present invention are aqueous and therefore, preferably may comprise water, more preferably may comprise water in an amount of from 60% to 98%, even more preferably of from 80% to 97% and most preferably 85% to 97% by weight of the total composition.

Preferably, the compositions of the present invention are thickened. Thickening can be achieved by the addition of thickening components such as surfactants, more particularly anionic surfactants.

pH

The liquid compositions according to the present invention are preferably alkaline compositions. The pH of the liquid compositions herein, as is, is preferably from 12 to 14 measured at 25° C. It is in this alkaline range that the optimum stability and performance of the hypohalite as well as fabric whiteness and/or safety are obtained.

Accordingly, the compositions herein may further comprise an acid or a source of alkalinity to adjust the pH as appropriate. Suitable sources of alkalinity are the caustic alkalis such as sodium hydroxide, potassium hydroxide and/or lithium hydroxide, and/or the alkali metal oxides such as sodium and/or potassium oxide. A preferred source of alkalinity is a caustic alkali, more preferably sodium hydroxide and/or potassium hydroxide. Typical levels of such sources of alkalinity, when present, are of from 0.1% to 1.5% by weight, preferably from 0.5% to 1.5% by weight of the composition.

Hypohalite Bleach

As a first essential ingredient, the bleaching compositions of the present invention comprise a hypohalite bleach or a mixture thereof.

Suitable hypohalite bleaches may be provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

In a preferred embodiment, said hypohalite bleach is an alkali metal and/or alkaline earth metal hypochlorite. More preferably, said hypohalite bleach is an alkali metal and/or alkaline earth metal hypochlorite selected from the group consisting of sodium hypochlorite, potassium hypochlorite, magnesium hypochlorite, lithium hypochlorite and calcium hypochlorite, and mixtures thereof. Even more preferably, said hypohalite bleach is sodium hypochlorite.

Preferably, the liquid bleaching compositions herein comprise said hypohalite bleach such that the content of active halide (for hypochlorite: $AvCl_2$) in the composition is of from 0.01% to 20% by weight, more preferably from 0.1% to 10% by weight, even more preferably from 0.5% to 6% and most preferably from 1% to 6% by weight of the composition.

Tri-Methoxy Benzoic Acid

As a second essential element the compositions of the present invention comprise a tri-methoxy benzoic acid or a salt thereof (TMBA) as a radical scavenger.

Generally, the tri-methoxy benzoic acid or a salt thereof has the general formula:

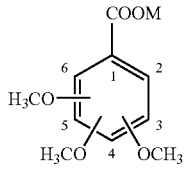

wherein: M is hydrogen, a cation or a cationic moiety. Preferably, M is selected from the group consisting of hydrogen, alkali metal ions and alkaline earth metal ions. More preferably, M is selected from the group consisting of hydrogen, sodium and potassium. Even more preferably, M is hydrogen.

Preferably, said tri-methoxy benzoic acid or a salt is selected from the group consisting of 3,4,5,-trimethoxy benzoic acid, a salt thereof, 2,3,4-trimethoxy benzoic acid, a salt thereof, 2,4,5-trimethoxy benzoic acid, a salt thereof and a mixture thereof. More preferably, said alkoxylated benzoic acid or the salt thereof is 3,4,5,-trimethoxy benzoic acid or a salt thereof. Even more preferably, said alkoxylated benzoic acid or the salt thereof is 3,4,5,-trimethoxy benzoic acid.

Suitable trimethoxy benzoic acids or salts thereof are commercially available from Aldrich, Merck or Hunan Shineway.

Typically, the bleaching composition herein may comprise from 0.001% to 5%, preferably from 0.005% to 2.5% and more preferably from 0.01% to 1.0% by weight of the total composition of said tri-methoxy benzoic acid or a salt thereof.

Compound Selected from the Group Consisting of Bleach-Unstable Brighteners and Bleach-Unstable Coloring-Agents As a third essential element the compositions of the present invention comprise a compound selected from the group consisting of bleach-unstable brighteners, and bleach-unstable coloring-agents and mixtures thereof.

By a "bleach-unstable" compound it is meant herein, that said compound will be at least partially or even completely decomposed when incorporated in a hypohalite bleach-containing composition free of any stabilization system.

In practice bleaching compositions as described herein are not used immediately after their manufacture. Indeed, such bleaching compositions are shipped after production to their point of sale, stored for some time at the point of sale (shelf storage) and stored by the end-user of said bleaching composition prior to use. Such prolonged storage conditions after the manufacture of the bleaching compositions herein, have to be taken into account when determining whether an ingredient or compound is bleach-stable or not.

The bleach-stability of a compound can be assessed in the laboratory using a rapid ageing test ("RAT"). Such a RAT simulates under laboratory conditions the prolonged storage conditions after the manufacture of the bleaching compositions herein. In a RAT aqueous compositions comprising 3% of active chlorine by weight of the composition (3.15% of sodium hypochlorite) and 0.02% by weight of brightener to be tested for bleach stability or 0.002% by weight of coloring-agent to be tested for bleach stability. The compositions are stored for 10 days at 50° C.±0.5° C. and the activity of said compound is assessed after the 10 days of storage.

By a "bleach-unstable" brightener, it is therefore to be understood herein a brightener that typically undergoes more than 80% loss of activity for the brightener at 50° C.±0.5° C. after 10 days of storage as compared to its activity in a 'fresh' composition comprising 0% of active halide by weight of the composition (in order to avoid immediate decomposition of the compound) and 0.02% by weight of brightener.

By a "coloring-agent" it is meant herein a pigment and/or a dye and/or other materials used in order to provide color to the liquid compositions herein. Usually water-insoluble coloring-agents are referred to as pigments and water-soluble coloring-agents are referred to as dyes. However, in the prior art these definitions are not followed in all instances. Therefore, in order to avoid confusion, the term coloring-agent encompasses all means available to provide color to a liquid composition.

By a "bleach-unstable" coloring-agent, it is therefore to be understood herein a coloring-agent that typically undergoes more than 80% loss of activity for dye or pigment at 50° C.±0.5° C. after 10 days of storage as compared to its activity in a 'fresh' composition comprising 0% of active halide by weight of the composition (in order to avoid immediate decomposition of the compound) and 0.002% by weight of dye or pigment.

By "activity" it is meant herein for a brightener, its fluorescence and for coloring-agents, their ability to provide color to a composition.

To assess the bleach incurred loss activity of a given brightener, the fluorescence under a UV lamp of an 'aged' composition comprising 3% of active chlorine by weight of the composition (3.15% of sodium hypochlorite) and 0.02% by weight of said brightener and aged in a RAT as described above is compared to the fluorescence under a UV lamp of a 'fresh' composition comprising 0% of active halide by weight of the composition and 0.02% by weight of said compound.

The bleach incurred loss activity of a brightener can be judged by visual grading. The visual grading may be performed by a group of expert panelists using panel score units (PSU), with a PSU-scale ranging from 0, meaning no noticeable difference in fluorescence of the 'aged' composition versus the 'fresh' composition, to 5, meaning a clearly noticeable difference in fluorescence of the 'aged' composition versus the 'fresh' composition, can be applied. For example, a PSU score of 1 means 20% loss of fluorescence activity in an 'aged' composition as compared to the activity in a 'fresh' composition.

Alternatively, bleach incurred loss of activity of a brightener can be assessed using an HPLC (high pressure liquid chromatography) analyses wherein brightener-levels before and after a RAT are quantitatively measured.

To assess the bleach incurred loss activity of a given coloring-agent (such as a pigment or a dye), the color of an 'aged' composition comprising 3% of active chlorine by weight of the composition (3.15% of sodium hypochlorite) and 0.002% by weight of said coloring-agent and aged in a RAT as described above is compared to the color of a 'fresh' composition comprising 0% of active halide by weight of the composition and 0.002% by weight of said coloring-agent.

The bleach-incurred loss of activity of a given coloring-agent can be judged by visual grading. The visual grading may be performed by a group of expert panelists using panel score units (PSU), with a PSU-scale ranging from 0, meaning no noticeable difference in color of the 'aged' composition versus the 'fresh' composition, to 5, meaning a clearly noticeable difference in color of the 'aged' composition versus the 'fresh' composition, can be applied. For example, a PSU score of 1 means 20% loss of coloring activity in an 'aged' composition as compared to the activity in a 'fresh' composition.

Alternatively, bleach incurred loss activity of a given coloring-agent can be assessed using a spectrometer analyses. In the specific, the instrument used is a Lambda UV/VIS spectrometer from Perkin Elmer.

Bleach-Unstable Brighteners

The compositions herein may comprise a bleach-unstable brightener as defined herein above. Said bleach-unstable brightener may be incorporated at a level of from 0.001% to 1.0%, preferably from 0.005% to 0.5%, more preferably from 0.005% to 0.3% and most preferably from 0.008% to 0.1%, by weight of the composition.

Examples of suitable bleach-unstable brighteners include: disodium-4,4'-bis-(2-sulfostyril)-biphenyl, disodium-4,4'-bis[(4,6-di-anilino-s-triazine-2-yl)-amino]-2,2'-stilbenedisulfonate, and 4,4'-bis-[(4-anilino-6-morpholino-s-triazine-2-yl)-amino]-2,2'-stilbenedisulfonate, 4,4'-bis-[(4-anilino-6-bis-2(2-hydroxyethyl)-amino-s-triazine-2-yl)-amino]-2,2'-stilbenedisulfonate and mixtures thereof.

Furthermore, suitable bleach-unstable brighteners useful in the present invention are those having the structural formula:

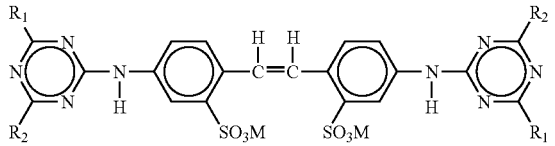

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba Specialty Chemicals.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba Specialty Chemicals.

When in the above formula, $R_1$ is anilino, $R_2$ is morphilino and M is a cation such as sodium, the brightener is 4,4'-bis [(4-anilino-6-morphilino-s-triazine-2-yl)amino]2,2'-stilbenedisulfonic acid, sodium salt. This particular brightener species is commercially marketed under the tradename Tinopal AMS-GX® by Ciba Specialty Chemicals.

Another suitable bleach-unstable brightener is Optiblanc BRB® available from 3V sigma.

Other substituted stilbene 2,2'-disulfonic acid derivatives also include 4-4'-bis(2-2' styryl sulfonate)biphenyl, commercially available from Ciba Specialty Chemicals under the trade name Brightener 49® or other hydrophilic brighteners like for example Brightener 3® or Brightener 47®, also commercially available from Ciba Specialty Chemicals.

Preferred bleach-unstable brighteners herein are selected from the group consisting of: disodium-4,4'-bis-(2-sulfostyril)-biphenyl (commercially available under the tradename Brightener 49®, from Ciba Specialty Chemicals); disodium-4,4'-bis-[(4,6-di-anilino-s-triazine-2-yl)-amino]-2,2'-stilbenedisulfonate (commercially available under the tradename Brightener 36®, from Ciba Specialty Chemicals); 4,4'-bis-[(4-anilino-6-morpholino-s-triazine-2-yl)-amino]-2,2'-stilbenedisulfonate (commercially available under the tradename Brightener 15®, from Ciba Specialty Chemicals); and 4,4'-bis-[(4-anilino-6-bis-2(2-hydroxyethyl)-amino-s-triazine-2-yl)-amino]-2,2'-stilbenedisulfonate (commercially available under the tradename Brightener 3®, from Ciba Specialty Chemicals); and mixtures thereof.

In a highly preferred embodiment according to the present invention, the bleach-unstable brightener herein is disodium-4,4'-bis-(2-sulfostyril)-biphenyl. Disodium-4,4'-bis-(2-sulfostyril)-biphenyl is commercially available under the tradename Brightener 49®, from Ciba Specialty Chemicals.

Accordingly, by a "bleach-stable" brightener, it is understood a brightener that typically undergoes equal or less than 80% loss of activity for the brightener at 50° C.±0.5° C. after 10 days of storage as compared to its activity in a 'fresh' composition comprising 0% of active halide by weight of the composition (in order to avoid immediate decomposition of the compound) and 0.02% by weight of brightener.

Examples of suitable bleach-stable brighteners include benzoxazole,2,2'-(thiophenaldyl)bis having the following formula C18H10N2O2S, commercially available from Ciba Specialty Chemical under the trade name Tinopal SOP®. Another example of such a brightener is bis(sulfobenzofuranyl)biphenyl, commercially available from Ciba Specialty Chemical under the trade name Tinopal PLC®.

Bleach-Unstable Coloring-Agents

The compositions herein may comprise a bleach-unstable coloring-agent as defined herein above. Said bleach-unstable coloring-agent may be incorporated at a level of from 0.001% to 1.0%, preferably from 0.005% to 0.5%, more preferably from 0.005% to 0.3% and most preferably from 0.008% to 0.1%, by weight of the composition.

Examples of suitable bleach-unstable coloring-agents include: blue copper phtalocyanine (commercially available under the tradename Dye Pigmosol Blue 15®, from BASF), accosperse cyan blue GT, Aqualine blue, Arlocyanine blue PS, Bahama blue BC, Bermuda blue, Blue GLA, Blue phtalocyanine alpha-form, Blue toner GTNF BT 4651, Calcotone blue GP, Ceres blue BHR, Chromatex blue BN, Chromofine blue 4920, C.I. 74160, C.I. pigment blue 15, Congo blue B 4, Copper(II) phtalocyanine, Copper phtalocyanine, Copper beta-phtalocyanine, Copper(2+) phtalocyanine, alpha.-Copper phtalocyanine, beta-Copper phtalocyanine, Copper phtalocyanine blue, Copper tetrabenzoporphyrazine, Cromofine blue 4950, Cromophtal blue 4G, Cupric phtalocyanine, Cyan blue BNC 55-3745, Cyanine blue BB and others, Cyan peacock blue G, Dainichi cyanine blue B, Daltolite fast blue B, Duratint blue 1001, EM blue NCB, Euvinyl blue 702, Fastogen blue 5007, Fastolux blue, Fastolux peacock blue, Fenalac blue B disp, Franconia blue A 4431, Graphtol blue BL, Helio blue B, Helio fast blue B, Heliogen blue and others, Hostaperm blue AFN, Irgalite blue BCA, Irgalite blue LGLD, Irgalite fast brilliant blue BL, Irgaplast blue RBP, Isol fast blue B, Isol fast blue toner BT, Isol phthalo blue B, Japan blue 404, LBX 5, Leophoton, Lioconductor ERPC, Lionol blue E, Liophoton blue ER, Liophoton ERPC, Liophoton TPH 278, Lufilen blue 70-8100, Lumatex blue B, Lutetia fast cyanine R, Lutetia percyanine BRS, Microlith blue 4GA, Monarch blue G, Monarch blue toner NCNF X 2810, Monastral blue, Monastral blue B, Monastral fast blue, Monastral fast paper blue B, Monolite fast blue BNVSA, No 2712 cyanine blue B, Nyastral blue BC, Nylofil blue BLL, Ocean blue, Palomar blue B 4773, Peacoline blue, Permaline blue, Permanent blue BT 398, Phthalo blue B base, (Phthalocyaninato)copper, .alpha.-Phtalocyanine blue, beta-Phtalocyanine blue, Phtalocyanine light blue VK, Phthalogen brilliant blue IF 3GK, Phthalogen turquoise IFBK, Pigment blue ciba 376S, Pigment fast blue BN, Pigment sky blue phtalocyanine VK, Plastol blue B, Polymo blue FFG, PV fast blue A 2R,PV fast blue B, Ramapo blue, Renol blue B 2G-H, Resamine fast blue B, Resanine blue B 4703, Resino blue F, Rubber blue BKA, Sandorin blue 2GLS, Sanyo cyanine blue BN, Segnale light turquoise BDS, Siegle fast blue BS, Siegle fast blue LBGO, Skyline blue B4712, Solastral blue B, Solfast sky blue, Sumkiaprint cyanine blue GN-O, Sumitone cyanine blue HB, Sunfast blue, Suprapal green 3×4A041, Synthaline blue, Tetor blue, Thalo blue no. 1, Turquoise blue base G, Unisperse blue G-E, Versal blue A, Iragon Blue DBL86, Dispers blue 69-007, and Hostafine Blue B2G.

Preferred bleach-unstable coloring-agents herein are selected from the group consisting of: blue copper phtalocyanine (commercially available under the tradename Dye Pigmosol Blue 15®, from BASF); Direct Blue 86 (commercially available under the tradename Iragon Blue DBL86® from Clariant); Pigment Blue 15:1 (commercially available under the tradename Disperse Blue 69-007® from BASF); and Pigment Blue 15:3 (commercially available under the tradename Hostafine Blue B2G® from Clariant); and mixtures thereof.

In a highly preferred embodiment according to the present invention, the bleach-unstable coloring-agent herein is blue copper phtalocyanine. Blue copper phtalocyanine is commercially available under the tradename Dye Pigmosol Blue 15®, from BASF).

Accordingly, under a "bleach-stable" coloring-agent it is understood a coloring-agent that typically undergoes less than or equal of 80% loss of activity for dye or pigment at 50° C.±0.5° C. after 10 days of storage as compared to its activity in a 'fresh' composition comprising 0% of active halide by weight of the composition (in order to avoid immediate decomposition of the compound) and 0.002% by weight of the coloring-agent.

An example of a bleach-stable coloring-agents includes blue ultramarine blue that is sold as C.I. Pigment Blue 29; C.I. 77007 by Holliday Pigments. Another bleach-stable coloring-agents is CI 69825 and is known under the names of C.I. Vat Blue and C.I. Pigment Blue 64.

It has now been surprisingly found that the specific TMBA radical scavenger of the present invention is capable of stabilising bleach-unstable brighteners, bleach-unstable coloring-agents that are particularly prone to attacks by hypohalite bleaches and hence are extremely difficult to be stably incorporated into bleaching compositions comprising. Indeed, the TMBA radical scavenger herein shows a significantly improved stabilization performance for bleach-unstable brighteners, bleach-unstable coloring-agents in hypohalite bleach-containing compositions as compared to currently known radical scavengers, such as benzoic acid, p-toluene sulfonate and sodium m-methoxybenzoic acid and m-anisic acid.

Furthermore, it has been surprisingly found that the specific TMBA radical scavenger of the present invention leads to a significant reduction of loss of available chlorine of the compositions herein upon storage thereof. The % loss of available chlorine may be measured using the method described, for instance, in "Analyses des Eaux et Extraits de Javel" by "La chambre syndicate nationale de L'eau de Javel et des products connexes", pages 9-10 (1984). Said method consists in measuring the available hypohalite bleach in the fresh compositions, i.e. just after they are made, and in the same compositions after 10 days at 50° C.

Optional Chelating Agents

In the compositions of the present invention, the presence of a chelating agent in addition to radical scavenger is not compulsory, but is highly preferred.

It is believed that the presence of a chelating agent in the compositions of the present invention further contributes to the stability of the bleach-unstable brighteners, pigments and/or dyes, especially upon prolonged periods of storage as well as fabric safety and fabric whiteness.

Suitable chelating agents may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof.

Chelating agents may be desired in the compositions of the present invention, preferably phosphate chelating agents like phytic acid, as they further contribute to the benefit delivered by the radical scavengers herein by further improving the stability of the brighteners, thus delivering effective whiteness performance in any laundry application upon ageing of the compositions, i.e. after prolonged periods of storage.

Suitable phosphonate chelating agents for use herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Suitable phosphate chelating agents for use in the compositions of the present invention are described in EP-A-0 867 502 in the section titled "The Phosphate ingredient", such ingredients are specifically incorporated herein by reference, especially for their fabric whitening benefit (i.e., yellowing prevention effect) and/or fabric safety benefit. All phosphate ingredients described in EP-A-0 867 502 in the section titled "The Phosphate ingredient" are suitable for use herein. Preferred phosphate chelating agents for use herein are linear phosphate ingredients, wherein R in the formula in the section titled "The Phosphate ingredient" of EP-A-0 867 502 is M and wherein n is 1 (pyrophosphate) or n is 2 (tripolyphosphate (STPP)), most preferably wherein n is 2. The most commonly available form of these phosphates is where M is Sodium. Indeed, preferred phosphate chelating agents for use in the compositions of the present invention are pyrophosphate and/or tripolyphosphate (STPP), more preferably Na phosphate and/or Na tripolyphosphate (STPP).

Phytic acid, which is particularly suitable for use herein, is a hexa-phosphoric acid that occurs naturally in the seeds of many cereal grains, generally in the form of the insoluble calcium-magnesium salt. It may also be derived from corn steep liquor. Commercial grade phytic acid is commercially available from J. T. Baker Co., e.g. as a 40% aqueous solution. It is intended that the present invention covers the acidic form of phytic acid as well as alkali metal salt derivatives thereof, particularly sodium or potassium salts thereof. Sodium phytate is available from Jonas Chemical Co (Brooklyn, N.Y.). In fact since the typical pH of the compositions of the present invention are in the alkaline pH range, the phytic acid component exists primarily as the ionized salt in the liquid compositions herein even if it is added in its acidic form. Mixtures of such salts of phytic acid are also covered.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Particularly preferred chelating agents for use herein are phosphate chelating agents like sodium pyrophosphate, sodium tripolyphosphate, phytic acid, and mixtures thereof.

Typically, the compositions herein comprise up to 10%, preferably from 0.01% to 5% by weight, more preferably from 0.05% to 2% and most preferably from 0.1% to 1.5% by weight of the composition of a chelating agent or a mixture thereof.

Optional pH Buffering Components

In the compositions of the present invention, the presence of a pH buffering component is not compulsory, but is preferred.

It is believed that the presence of a pH buffering component in the compositions of the present invention further contributes to the stability of these compositions, effective whiteness performance as well as to the fabric safety. Indeed, the pH buffering component allows to control the alkalinity in the bleaching solution, i.e. maintain the pH of the bleaching solution at a pH of at least 7.5, preferably at least 8, and more preferably at least 8.5 for a longer period of time starting from the moment at which the dilution is completed (e.g. when the bleaching composition of the present invention is diluted in the bleaching solution at a dilution level of 500:1 (water: composition)). It is believed that the pH buffering component may also contribute to stability of the bleach-unstable ingredients herein.

The pH buffering component ensures that the pH of the composition is buffered to a pH value ranging from 7.5 to 13, preferably from 8 to 12, more preferably from 8.5 to 11.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. More preferably alkali metal salts of carbonate, silicate and borate. The preferred alkali metal salts for use herein are sodium and potassium.

Suitable boron salts or mixtures thereof for use herein include alkali metal salts of borates and alkyl borates and mixtures thereof. Particularly preferred boron salts herein include boric acid, alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g. calcium carbonate resulting in an amount of up to 0.4% by weight of by-product within the hypohalite composition. However, at such amount, the by-product will not have the buffering action defined above.

Liquid bleaching compositions herein may contain an amount of pH buffering component of from 0.5% to 9% by weight, preferably from 0.5% to 5% by weight, and more preferably in an amount of from 0.6% to 3% by weight of the composition.

Optional Surfactants

The liquid compositions of the present invention may comprise a surfactant as an optional ingredient. Said surfactants may be present in the compositions herein in amounts of from 0.1% to 50%, preferably from 0.1% to 40% and more preferably from 1% to 30% by weight of the composition.

Surfactants suitable for use herein include anionic surfactants, nonionic surfactants, cationic surfactants, amphoteric surfactants, zwitterionic surfactants, and mixtures thereof.

In a particularly preferred embodiment the surfactant is selected from the group consisting of alkyl sulphate, alkyl ether sulphate and mixtures thereof.

Suitable anionic surfactants for use in the compositions herein include water-soluble salts or acids of the formula $ROSO_3M$ wherein R preferably is a $C_{10}$-$C_{24}$ hydrocarbyl, preferably linear or branched alkyl having a $C_{10}$-$C_{20}$ alkyl component, more preferably a $C_{12}$-$C_{18}$ linear or branched alkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Other suitable anionic surfactants for use herein are water-soluble salts or acids of the formula $RO(A)_mSO_3M$ wherein R is an unsubstituted $C_6$-$C_{24}$ linear or branched alkyl group having a $C_6$-$C_{24}$ alkyl component, preferably a $C_{10}$-$C_{20}$ linear or branched alkyl, more preferably $C_{12}$-$C_{18}$ linear or branched alkyl, A is an ethoxy or propoxy unit, m is greater than zero, typically between about 0.5 and about 30, more preferably between about 0.5 and about 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulfate, $C_{12}$-$C_{18}E(1.0)$ sulfate, $C_{12}$-$C_{18}$ alkyl polyethoxylate (2.25) sulfate, $C_{12}$-$C_{18}E(2.25)$ sulfate, $C_{12}$-$C_{18}$ alkyl polyethoxylate (3.0) sulfate, $C_{12}$-$C_{18}E(3.0)$ sulfate, and $C_{12}$-$C_{18}$ alkyl polyethoxylate (4.0) sulfate, $C_{12}$-$C_{18}E(4.0)$ sulfate, wherein the counterion is conveniently selected from sodium and potassium.

In a particularly preferred embodiment of the present invention the surfactant system used is an anionic surfactant system, namely alkyl alkoxy (preferably ethoxy) sulphate alone for example alkyl(ethoxy) 3 sulphate or in combination with a co-surfactant, preferably a C2-C10 alkyl sulphate and/or a C8-C22 alkyl or aryl sulphonate like C8-C22 benzene sulphonate and/or another alkyl alkoxy sulphate apart the 3 ethoxylated one. Indeed the presence of said alkyl(ethoxy) 3 sulphate alone or in combination with a co-surfactant provides the desired viscosity to the present compositions and delivers excellent stain removal properties to said compositions especially when used in any laundry application.

Typically compositions according to the present invention have a viscosity between 25 cps and 1500 cps, preferably between 50 cps and 1100 cps, depending of the ratio between $AE_3S$ and the co-surfactant, when measured with a Rheometer like Carri-med CSL2-1000 at the following viscosity parameters: angle: 1° 58, gap: 60, diameter: 4.0 cm, inner.: 63.60 at a temperature of 25° C. and a shear rate of 30 l/sec.

Other anionic surfactants useful for detersive purposes can also be used herein.

Particularly suitable nonionic surfactants for use herein are capped nonionic ethoxylated surfactants according to the formula:

$$R_1(OR_2)_nOR_3$$

wherein $R_1$ is a $C_8$-$C_{18}$ linear or branched alkyl or alkenyl group, aryl group, alkaryl group, preferably, $R_1$ is a $C_{10}$-$C_{15}$ alkyl or alkenyl group, more preferably a $C_{10}$-$C_{15}$ alkyl group; $R_2$ is a $C_2$-$C_{10}$ linear or branched alkyl group, preferably a $C_4$ group; $R_3$ is a $C_1$-$C_{10}$ alkyl or alkenyl group, preferably a $C_1$-$C_5$ alkyl group, and n is an integer ranging in the range of from 1 to 20, preferably from 1 to 10, more preferably from 1 to 5; or mixtures thereof. These surfactants are commercially available from BASF under the trade name Plurafac®, from HOECHST under the trade name Genapol® or from ICI under the trade name Symperonic®. Preferred capped nonionic ethoxylated surfactant of the above formula are those commercially available under the tradename Genapol® L 2.5 NR from Hoechst, and Symperonic® LF/CS 1100 from ICI.

Other suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Other suitable nonionic surfactants for use herein include the amine oxides corresponding to the formula:

$$RR'R''N\rightarrow O$$

wherein R is a primary alkyl group containing 6-24 carbons, preferably 10-18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10-18 carbons and R' and R" are both methyl. Exemplary of the preferred amine oxides are the N-decyldimethylamine oxide, N-dodecyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable nonionic surfactants for the purpose of the invention are the phosphine or sulfoxide surfactants of formula:

$$RR'R''A \rightarrow O$$

wherein A is phosphorus or sulfur atom, R is a primary alkyl group containing 6-24 carbons, preferably 10-18 carbons, and wherein R' and R" are, each, independently selected from methyl, ethyl and 2-hydroxyethyl. The arrow in the formula is a conventional representation of a semi-polar bond.

Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378. Additional synthetic detergents and listings of their commercial sources can be found in McCutcheon's Detergents and Emulsifiers, North American Ed. 1980.

Other Optional Ingredients

The bleaching compositions herein may further comprise a variety of optional ingredients such as bleach activators, soil suspenders, soil suspending polyamine polymers, polymeric soil release agents, foam reducing systems/agents, catalysts, dye transfer agents, perfumes, hydrotropes and solvents.

Process of Treating Fabrics

In the present invention, the bleaching composition of the present invention is used by applying the liquid bleaching composition to the fabric to be treated. The liquid compositions herein are applied onto the fabric per se in neat or diluted form.

The compositions herein are typically used in diluted form in a laundry operation. By "in diluted form" it is meant herein that the compositions for the bleaching of fabrics according to the present invention may be diluted by the user, preferably with water. Such dilution may occur for instance in hand laundry applications as well as by other means such as in a washing machine. Said compositions may be used at a dilution level of up to 1500:1 (solvent:composition), preferably from 5:1 to 1000:1 and more preferably from 10:1 to 700:1 (solvent:composition).

By "in its neat form", it is to be understood that the liquid bleaching compositions are applied directly onto the fabrics to be treated without undergoing any dilution, i.e., the liquid compositions herein are applied onto the fabrics as described herein.

Fabrics to be treated herein include, but are not limited to, clothes, curtains, drapes, bed linens, bath linens, tablecloths, sleeping bags and/or tents. By "treating a fabric", it is meant herein cleaning said and/or bleaching/disinfecting said fabric.

In the process of treating (e.g., cleaning and/or bleaching) a fabric, a bleaching composition herein is contacted with the fabrics to be treated.

This can be done either in a so-called "pretreatment mode", where a liquid bleaching composition, as defined herein, is applied neat onto said fabrics before the fabrics are rinsed, or washed, then rinsed, or in a "soaking mode" where a liquid or solid bleaching composition, as defined herein, is first diluted in an aqueous bath and the fabrics are immersed and soaked in the bath, before they are rinsed, or in a "through-the-wash mode", where a liquid or solid bleaching composition, as defined herein, is added in addition to a wash liquor formed by dissolution or dispersion of a typical laundry detergent, preferably in a washing machine. It is also essential in both cases, that the fabrics be rinsed after they have been contacted with said composition, before said composition has completely dried off.

More specifically, the process of bleaching fabrics according to the present invention preferably comprises the steps of first contacting said fabrics with a bleaching composition according to the present invention, then allowing said fabrics to remain in contact with said composition, for a period of time sufficient to bleach said fabrics, then rinsing said fabrics with water. If said fabrics are to be washed, i.e., with a conventional composition comprising at least one surface active agent, the washing of said fabrics with a detergent composition comprising at least one surface active agent may be conducted before the step of contacting said fabrics with said bleaching composition and/or in the step where said fabrics are contacted with said bleaching composition and/or after the step where said fabrics are contacted with the bleaching composition and before the rinsing step and/or after the rinsing step.

The bleaching composition may be used in dilute or neat form. Where it is used diluted, the bleaching composition should remain in contact with the fabric for typically 1 to 60 minutes, preferably 5 to 30 minutes. Whereas, when the bleaching composition is used in its neat form, it should remain in contact with the fabric for a much shorter time, typically 5 seconds to 30 minutes, preferably 1 minute to 10 minutes.

It is preferred to perform the bleaching process herein before said fabrics are washed. Indeed, it has been observed that bleaching said fabrics with the compositions herein (diluted and/or neat bleaching processes) prior to washing them with a detergent composition provides superior whiteness and stain removal with less energy and detergent than if said fabrics are washed first, then bleached.

Alternatively instead of following the neat bleaching process as described above (pretreatment application) with a rinsing step and/or a conventional washing step with a liquid or powder conventional detergent, the bleaching pre-treatment operation may also be followed by the diluted bleaching process as described above either in bucket (hand operation) or in a washing machine.

Process of Treating Hard-Surfaces

In another embodiment the present invention encompasses a process of treating a hard-surface with a composition, as defined herein, preferably wherein said process comprises the step of applying said composition to said hard-surface, more preferably only soiled portions thereof, and optionally rinsing said hard-surface.

In the process of treating hard-surfaces according to the present invention the composition, as defined herein, may be applied to the surface to be treated in its neat form or in its diluted form. In the diluted form, the composition is preferably diluted with up to 200 times its weight of water, preferably 80 to 2 times its weight of water, and more preferably 60 to 2 times its weight of water.

Depending on the end-use envisioned, the compositions herein can be packaged in a variety of containers including conventional bottles, bottles equipped with roll-on, sponge, brusher, sprayers, pouches, sachets, boxes, etc.

Technical Data

The following examples will further illustrate the present invention. The compositions are made by combining the listed ingredients in the listed proportions (weight % unless otherwise specified). The Example composition I is meant to exemplify compositions according to the present invention but is not necessarily used to limit or otherwise define the scope of the present invention. Example compositions II to VII are comparative examples.

| Composition I | |
|---|---|
| $AvCl_2$ | 3% |
| TMBA | 0.16% |
| Brightener BR49 ® | 0.02% |
| Dye (CuPht) | 0.002% |
| Water and minors | up to 100% |
| **Composition II** | |
| $AvCl_2$ | 3% |
| Benzoic Acid | 0.33% |
| Brightener BR49 ® | 0.02 |
| Dye (CuPht) | 0.002% |
| Water and minors | up to 100% |
| **Composition III** | |
| $AvCl_2$ | 3% |
| p-toluene sulfonate (PTS) | 1.0% |
| Brightener BR49 ® | 0.02% |
| Dye (CuPht) | 0.002% |
| Water and minors | up to 100% |
| **Composition IV** | |
| $AvCl_2$ | 3% |
| m-methoxy benzoic acid (MMBA) | 0.16% |
| Brightener BR49 ® | 0.02% |
| Dye (CuPht) | 0.002% |
| Water and minors | up to 100% |
| **Composition V** | |
| $AvCl_2$ | 3% |
| Na-xylene sulfonate (NaXS) | 1.0% |
| Brightener BR49 ® | 0.02% |
| Dye (CuPht) | 0.002% |
| Water and minors | up to 100% |
| **Composition VI** | |
| $AvCl_2$ | 3% |
| Radical Scavenger | 0% |
| Brightener BR49 ® | 0.02% |
| Dye (CuPht) | 0.002% |
| Water and minors | up to 100% |
| **Composition VII** | |
| $AvCl_2$ | 3% |
| TMBA | 0.16% |
| Tipopal SOP ® | 0.02% |
| Ultramarine blue pigment | 0.002% |
| Water and minors | up to 100% |

All examples have a pH of above 11, adjusted with NaOH.

Wherein:

$AvCl_2$: Available chlorine; compositions contain Na hypochlorite

TMBA is 3,4,5,-trimethoxy benzoic acid commercially available from Hunan Shineway -continued Brightener BR49 ® and Tipopal SOP ® are commercially available from Ciba Specialty Chemicals.

CuPht is blue copper phtalocyanine commercially available from BASF.

Ultramarine blue pigment is commercially available from Holliday Pigments under the tradename Pigment Blu 29 ®.

Examples I to VI have been aged in a RAT as described herein (10 days @ 50° C.) and Example VII has been aged in a RAT during 17 days @ 50° C. The bleach incurred loss activity of the brightener and coloring-agents present therein has been judged by visual grading as described herein above (for brightener the visual grading was done under UV lamps). Indeed, the bleach incurred loss activity of a given brightener or coloring-agents in the 'aged' compositions has been compared to the brightener or coloring-agents activity in a 'fresh' composition comprising 0% of active halide by weight of the composition (in order to avoid immediate decomposition of the compound) and 0.02% by weight of the same brightener or 0.002% by weight of the same coloring-agent.

Brightener and Coloring-Agent Activity Results

| Composition | PSU brightener activity (bleach incurred loss activity of the brightener) | PSU coloring-agent activity (bleach incurred loss activity of the coloring-agent) |
|---|---|---|
| Composition I | 1 | 0 |
| Composition II | 5 | 5 |
| Composition III | 5 | 5 |
| Composition IV | 5 | 5 |
| Composition V | 5 | 5 |
| Composition VI | 5 | 5 |
| Composition VII | 1 | 1 |

PSU brightener activity-scale ranging from 0, meaning no noticeable difference in fluorescence of the 'aged' composition versus the 'fresh' composition, to 5, meaning a clearly noticeable difference in fluorescence of the 'aged' composition versus the 'fresh' composition. PSU coloring-agent activity-scale ranging from 0, meaning no noticeable difference in color of the 'aged' composition versus the 'fresh' composition, to 5, meaning a clearly noticeable difference in color of the 'aged' composition versus the 'fresh' composition.

EXAMPLES

The following examples will further illustrate the present invention. The Examples compositions are meant to exemplify compositions according to the present invention but are not necessarily used to limit or otherwise define the scope of the present invention.

| | (wt %) |
|---|---|
| **Composition VIII** | |
| $AvCl_2$ | 3% |
| TMBA | 0.16% |
| BR 15 ® | 0.02% |
| Iragon Blue DBL86 ® | 0.002% |
| Water and minors | up to 100% |
| **Composition IX** | |
| $AvCl_2$ | 3% |
| TMBA | 0.16% |
| BR 3 ® | 0.02% |

-continued

| | (wt %) |
|---|---|
| Dispers Blue 69-007 ® | 0.002% |
| Water and minors | up to 100% |
| Composition X | |
| $AvCl_2$ | 3% |
| TMBA | 0.16% |
| BR 36 ® | 0.02% |
| Hoftafine Blue B2G ® | 0.002% |
| Water and minors | up to 100% |
| Composition XI | |
| $AvCl_2$ | 3% |
| TMBA | 0.16% |
| BR 49 ® | 0.02% |
| Cromofine Blue 4950 ® | 0.002% |
| Water and minors | up to 100% |

All examples have a pH of 11, adjusted with NaOH.

Iragon Blue DBL86 ® and Hostafine Blue B2G ® are commercially available from Clariant.

Disperse Blue 69-007 ® is commercially available from BASF.

Brightener BR 3 ®, Brightener BR 15 ® and Brightener BR 36 ® are commercially available from Ciba Specialty Chemicals.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mM" is intended to mean "about 40 mm".

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid bleaching composition comprising a. a hypohalite bleach wherein said hypohalite bleach, based on active halide, is present in an amount of from 0.01% to 20% by weight of the composition;

b. 0.16% of 3,4,5-trimethoxybenzoic acid or a salt thereof; and c. from about 0.001% to about 1.0% by weight of the total composition of a compound selected from the group consisting of disodium-4,4'-bis-(2-sulfostyril)-biphenyl, blue copper phthalocyanine and mixtures thereof.

2. A liquid bleaching composition according to claim 1, wherein said hypohalite bleach is an alkali metal and/or an alkaline earth metal hypochlorite.

* * * * *

UNITED STATES PATENT AND TRADEMARK OFFICE

CERTIFICATE OF CORRECTION

PATENT NO. : 7,910,536 B2
APPLICATION NO. : 12/437609
DATED : March 22, 2011
INVENTOR(S) : Briatore et al.

It is certified that error appears in the above-identified patent and that said Letters Patent is hereby corrected as shown below:

Column 12
Line 22, delete "CSL2-1000" and insert --CSL2-100®--.

Signed and Sealed this
Thirty-first Day of May, 2011

David J. Kappos

David J. Kappos
*Director of the United States Patent and Trademark Office*